United States Patent [19]

Minowa

[11] 4,270,197

[45] May 26, 1981

[54] ANALOG DISPLAY ELECTRONIC STOPWATCH

[75] Inventor: Yoshiki Minowa, Suwa, Japan

[73] Assignee: Kubushiki Kaisha Suwa Seikosha, Tokyo, Japan

[21] Appl. No.: 30,963

[22] Filed: Apr. 17, 1979

[30] Foreign Application Priority Data

Apr. 17, 1978 [JP] Japan ..... 53/44976

[51] Int. Cl.[3] ..... G04F 7/00; G04F 8/00

[52] U.S. Cl. ..... 368/102; 368/113

[58] Field of Search ..... 58/21.13, 38 R, 39.5, 58/74; 235/92 CC, 92 DE, 92 T, 92 TF, 92 GA; 368/101, 102, 107–113

[56] References Cited

U.S. PATENT DOCUMENTS

| | | | |
|---|---|---|---|
| 2,190,543 | 2/1940 | Ivie et al. | 58/39.5 |
| 3,884,035 | 5/1975 | Jeannet | 58/74 |

*Primary Examiner*—Vit W. Miska

*Attorney, Agent, or Firm*—Blum, Kaplan, Friedman, Silberman & Beran

[57] ABSTRACT

An analog display electronic stopwatch including at least one first hand driven during elapsed time measurement and a secondary hand driven after completion of elapsed time measurement is provided. The first hand indicates an arbitrary unit of elapsed time which is displayed during time measurement and the secondary hand indicates time in a fraction of the arbitrary time units, the secondary hand driven after elapsed time measurement. The stopwatch includes elapsed time measurement circuitry including a memory counter circuit for counting elapsed time in 1/100ths of a second and for providing a signal for driving a second and minute hand during time measurement, a secondary counter for providing a signal for driving a 1/100th second hand after completion of time measurement. The 1/100th second hand is driven to indicate the elapsed time under one second as determined by a coincidence detector for comparing the output of the secondary counter signal and that of the memory counter.

14 Claims, 3 Drawing Figures

ANALOG DISPLAY ELECTRONIC STOPWATCH

BACKGROUND OF THE INVENTION

This invention relates generally to an analog display electronic timepiece, and in particular to an improved analog display electronic stopwatch wherein a first hand is driven during elapsed time measurement and a secondary hand is driven after the completion of elapsed time measurement. Recently, electronic timepieces, particularly the digital quartz timepieces which include multi-function, have become popular. Analog display electronic timepieces have not taken full advantage of the highly accurate electronic circuit characteristics utilized in digital display devices, because the capabilities of the analog/display are limited by conventional mechanical display means.

This distinction is evident in the case of liquid crystal display electronic wristwatches which display time measured in 1/10th of a second units or 1/100th of a second units. There are no analog/displays available which perform the same function. This is due to the fact that there are substantial problems displaying time in the analog manner in such small units. For example, in order to measure time in 1/10th of a second units or 1/100th of a second units, each step of the hand must be completed in less than 1/10th of a second or 1/100th of a second. In this case, the wheel train wears out easily, motor rotation becomes unworkable and the electronic consumption of the motor increases. Accordingly, it would be desirable to provide an analog electronic timepiece which can display elapsed time in 1/100th of a second units, yet overcomes the aforementioned disadvantages and limitations of conventional analog display stopwatches.

SUMMARY OF THE INVENTION

Generally speaking, in accordance with the invention, an analog display electronic stopwatch including at least a first hand for displaying time in seconds during elapsed time measurement and a secondary hand for displaying time in 1/100th second units after completion of elapsed time measurement is provided. The timepiece includes an oscillator circuit for providing a high frequency time-standard signal; first divider circuit for producing low frequency time signals from the oscillator circuit; a manually operated start/stop gate circuit for controlling elapsed time counting by a first counter circuit for generating signals for driving at least a second hand and a minute hand for displaying elapsed time in seconds; a secondary switch cooperatively connected to the start/stop switch for regulating a gate circuit for commencing low-frequency counting by a secondary counter after elapsed time measurement is completed, the secondary counter counting and driving the 1/100th of a second hand until the secondary counter is indexed through counts to the same as the first counter as determined by a coincidence detector.

Accordingly, it is an object of this invention to provide an improved analog display electronic stopwatch.

Another object of the invention is to provide an improved analog display electronic stopwatch for displaying elapsed time in small time units.

A further object of the invention is to provide an improved analog display electronic stopwatch for measuring and displaying elapsed time in 1/100th of a second units.

Still another object of the invention is to provide an improved analog display electronic stopwatch having at least a first hand driven during elapsed time measurement and a secondary hand driven after completion of elapsed time measurement.

Still a further object of the invention is to provide an improved analog display electronic stopwatch wherein elapsed time in fractions of a second is stored in the memory of a memory counter circuit and displayed after completion of elapsed time measurement.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
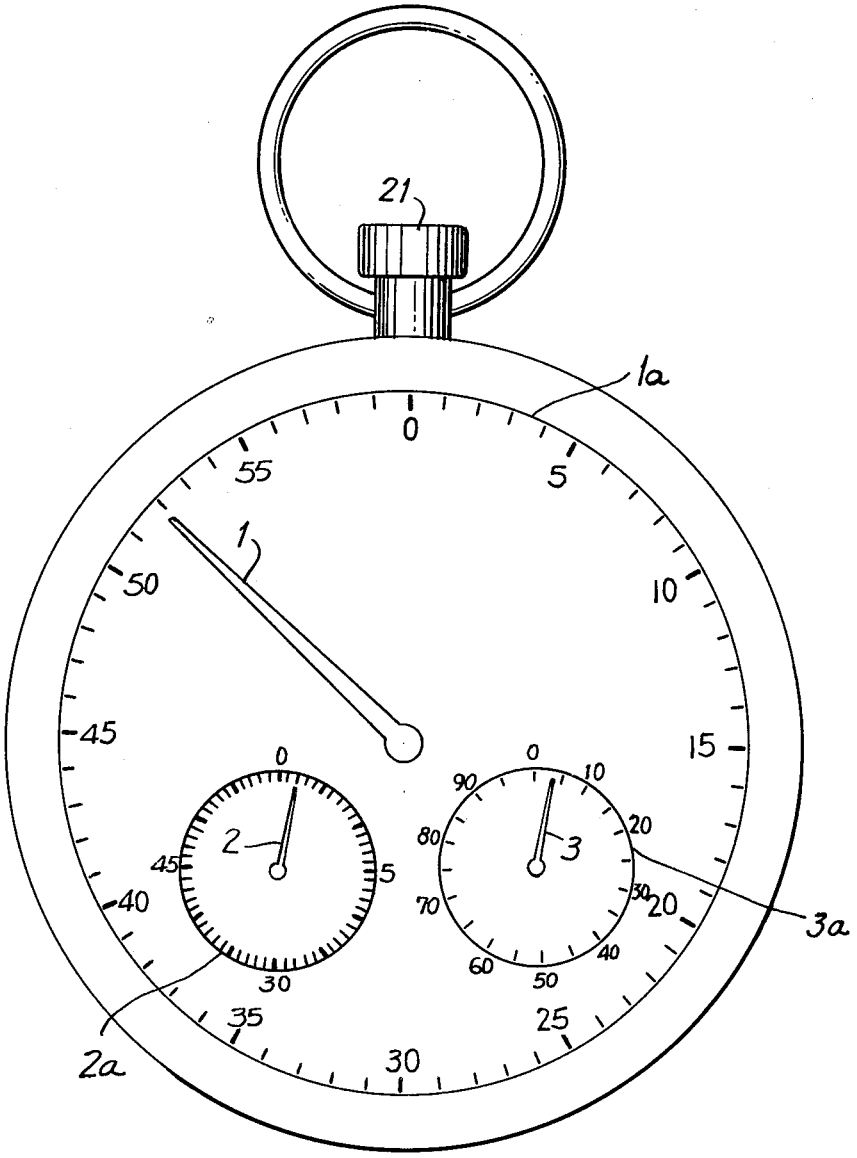
FIG. 1 is a plan view illustrating an analog display electronic stopwatch constructed and arranged in accordance with the invention.

Referring to FIG. 1, a plan view of an analog display electronic stopwatch constructed and arranged in accordance with the invention is shown. The stopwatch includes a second hand 1 for indicating elapsed time in seconds from 1 to 60 on an outer circular scale 1*a* disposed about the periphery of the circular stopwatch face. The stopwatch also includes a smaller minute hand 2 for recording elapsed time from 0 to 60 minutes on an inner smaller scale dial 2*a*. A 1/100th of a second hand 3 is provided on a second smaller 0 to 100 scale 3*a* on the face of the stopwatch for indicating elapsed time in 1/100th of a second units after completion of elapsed time measurement. The stopwatch further includes a switch 21 for manually operating the stopwatch as will be more fully described in connection with the description of FIG. 2.

Figure 2:
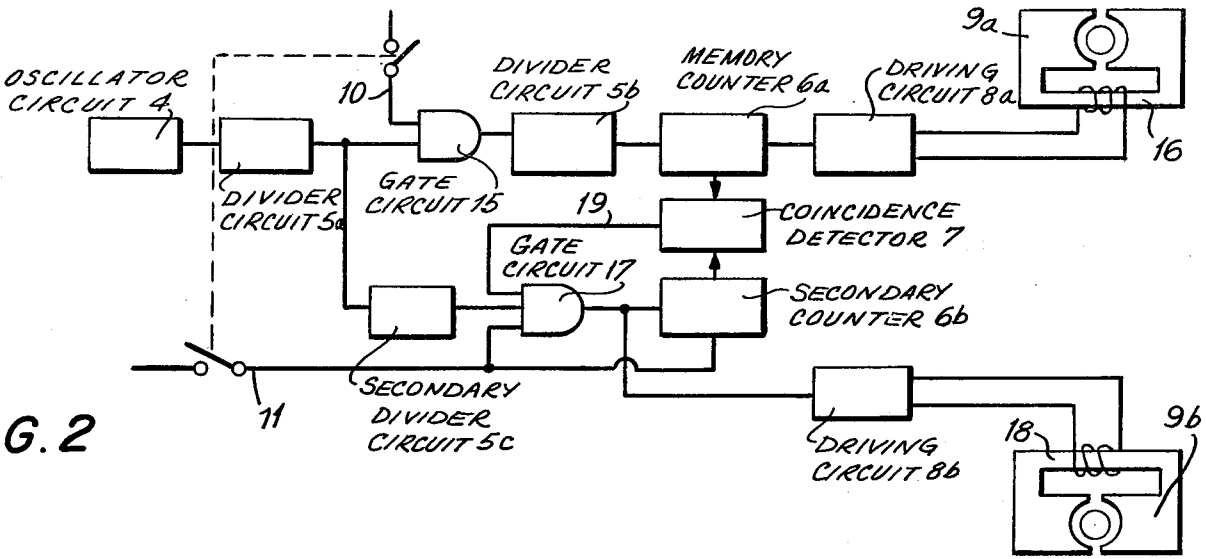
FIG. 2 is a block circuit diagram of the analog display electronic stopwatch illustrated in FIG. 1.

Referring now to FIG. 2, a block diagram of the electronic circuit for the stopwatch constructed and arranged in accordance with the invention is illustrated. An oscillator circuit 4 includes a high frequency time standard such as a quartz crystal vibrator or the like for producing a high frequency time standard signal typically on the order of $2^{16}$ Hz. The high frequency time standard signal, produced by oscillator circuit 4, is applied to a divider circuit 5*a* comprised of a plurality of series-connected divider stages, which divider stages apply a first intermediate frequency signal to gate circuit 15 and to secondary divider circuit 5*c*. Gate circuit 15 is an AND gate and has as its other input a manually operated start/stop switch 10, which switch corresponds to stopwatch actuating switch 21 in FIG. 1. The output of gate circuit 15 is coupled through a further divider circuit 5*b* to a memory counter 6*a* that is adapted to count through a counting cycle of one to one hundred in response to the output of divider circuit 5*b* and apply a 1 Hz low frequency timing signal to the driving circuit 8*a*. Driving circuit 8*a*, in response to the 1 Hz low frequency timing signal produced by the memory counter 6*a* applies a signal 13, illustrated in FIG. 3, to a drive coil 16 of a step motor 9*a* in order to effect a stepping of same once each second and thereby advance second hand 1 and minute hand 2 of a stopwatch in a conventional manner.

As aforenoted, divider circuit 5*a* is also coupled to secondary divider circuit 5*c*. Secondary divider circuit 5*c* is coupled to a first input of gate circuit 17, which gate circuit is comprised of an AND gate. The output of gate circuit 17 is coupled to a secondary counter 6*b* and to a secondary driving circuit 8*b*. Secondary counter 6*b* is provided with a counting cycle of 100 and is adapted to apply a counting signal representative of the time counted thereby to a coincidence detector 7, which coincidence detector is also adapted to receive the counting signal representative of the count stored in memory counter 6*a*. Furthermore, coincidence detector 7, in response to detecting coincidence between the count of memory counter 6*a* and secondary counter 6*b*, is adapted to apply a coincidence signal to a further input of gate circuit 17. The third input of gate circuit 17 is coupled to a switch 11, which switch is coupled to start/stop switch 10 and is coordinately operated therewith in order to assure that a HIGH level binary signal is applied to the input of gate circuit 17 and to the reset terminal of secondary counter 6*b* at the time that the stopwatch stops measuring elapsed time in response to operation of start/stop switch 10.

Figure 3:
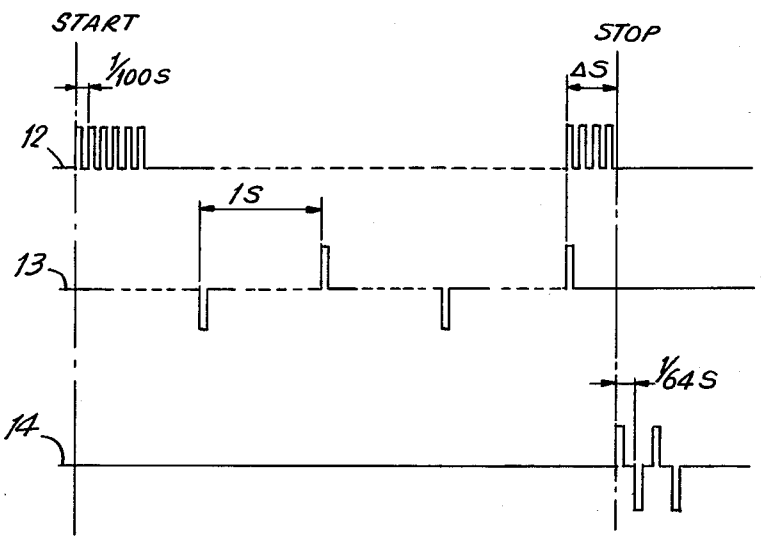
FIG. 3 is a timing chart of the electronic circuit for the stopwatch as illustrated in FIG. 2.

Accordingly, reference is made to FIG. 3 in order to obtain an understanding of the operation of the stopwatch circuit depicted in FIG. 2. When elapsed time is to be measured by the stopwatch, start/stop switch 10 is placed in its start position and is closed, thereby applying a HIGH level binary signal to the second input of gate circuit 15 to permit the intermediate frequency signal produced by divider circuit 5*a* to be transmitted to divider circuit 5*b*. In response to the intermediate frequency signal produced by divider circuit 5*a*, divider circuit 5*b* produces a signal 12, illustrated in FIG. 3, which signal is a 100 Hz signal.

Divider circuit 5*b* applies the 100 Hz signal to memory counter 6*a* thereby indexing memory counter 6*a* through its one hundred counting cycle and thereby effecting the drive of the step motor 9*a* to advance second hand 1 and minute hand 2 incrementally for providing a display of elapsed minutes and seconds as illustrated in FIG. 1. At this time 1/100th of a second hand 3 remains set at zero and is not moved.

At the instant that the measurement of elapsed time is completed, manually operated start/stop switch 10 is operated to open the switch, thereby closing AND gate 15 and cutting off the application of the intermediate frequency signal produced by divider circuit 5*a* to divider circuit 5*b*. At this time, divider circuits 5*a* and 5*b* are reset and no further signals are provided to motor 9*a*. The elapsed time in 1/100th of a second units under the next full second, shown as ΔS on pulse 12 in FIG. 3, is memorized in memory counter 6*a*. Coincident with the opening of switch 10 switch 11 is closed, thereby applying a HIGH level binary signal to secondary counter 6*b* to reset the count thereof to zero and further apply a HIGH level binary signal to gate circuit 17. Additionally, coincidence counter 7 will continue to apply a HIGH level binary level signal to gate circuit 17 until such time as it detects coincidence between the count of memory counter 6*a* and the count of secondary counter 6*b*. Accordingly, in response to the closing of switch 11, a secondary divider circuit 5*c* will apply a signal having a frequency of 100 Hz through gate circuit 17 to secondary counter 6*b* which has been reset to zero by the closing of manually operated switch 11.

In addition, the 100 Hz signal generated by secondary divider circuit 5*c* is also transmitted through gate circuit 17 to a driving circuit 8*b* and in turn to a drive coil 18 of a step motor 9*b* to begin indexing 1/100th second hand 3 to be rapidly advanced at 1/100th of a second increments. When coincidence detector 7 detects coincidence between the count of memory counter 6*a* and secondary counter 6*b*, the coincidence detector applies a LOW level binary coincidence signal 19 to the third input of gate circuit 17 to inhibit the transmission of the signal from secondary divider circuit 5*c* to secondary counter 6*b* and driving circuit 8*b* and thereby prevent the 1/100th of a second clock hand 3 from being further advanced. Moreover, because of the coordinate relationship between start/stop switch 10 and switch 11, when it is again desired to measure elapsed time, switch 11 will be opened and switch 10 closed in order to commence the measurement of elapsed time once again. Moreover, although not shown, conventional stopwatch resetting means can be utilized to reset second hand 1, minute hand 2 and 1/100th of a second clock hand 3 at the same time, in order to permit the wristwatch to commence counting elapsed time from a count of zero minutes, zero seconds and zero 1/100th of a second.

Motor 9*b* may be driven by the driving pulse as indicated by timing pulse 14 in FIG. 3 when 1/100th of a second hand 3 is advanced. Timing pulse 14 need not always be of the same frequency as the smallest time unit to be displayed, such as timing pulse 12. The incremental advancement of 1/100th of a second hand may be for each 1/64th of a second as indicated by timing pulse 14 in accordance with the exemplary embodiment of the invention. Additionally, the incremental advance of 1/100th of a second hand 3 may be in smaller units than the 1/100th of a second unit, or as small as the mechanical tolerances of the motor permit. The time necessary for advancing 1/100th of a second hand 3 is of no practical effect if it differs from the time necessary for advancing the 1/100th of a second hand 3 in 1/100th of a second unit as this is accomplished after the lapsed time measurement has been completed.

In the exemplary embodiment described in connection with the drawing, second hand 1 and 1/100th of a second hand 3 are driven by step motors 9*a* and 9*b*, respectively. However, it is clearly within the scope of the invention that operation of both minute hand 1 and second hand 2 during elapsed time measurement, and driving of 1/100th of second hand 3 after completion of elapsed time measurement may be by the same motor. In this latter embodiment switching of the wheel clutching mechanism and assemblies of a conventional chronograph wristwatch would be utilized.

In accordance with the invention, the incremental advancement of second hand 1 and minute hand 2 during the elapsed time measurement is the same as that of a conventional analog type electronic timepiece. In this case the power comsumption is reduced to 1/100th to several tenths that of a watch in which the second and minute hands are incrementally advanced in 1/100th of a second units. Moreover, 1/100th of a second hand 3 is advanced only after completion of elapsed time measurement and in steps a maximum of 99 times for any one measurement. Thus, it is difficult to wear out the gear wheel train and the instant invention provides a stopwatch which will endure at least as long as that of a conventional electronic wristwatch. In addition, in the embodiment described herein the invention has been applied to the 1/100th of a second hand of a stopwatch. Of course, the invention may be applied to indicate elapsed time measured and stored in minute or hour units. In this case, the time indication may be adjusted for temperature, humidity and the like. Accordingly, the invention finds many applications for providing an analog type electronic timepiece having the multi-functions usually found in digital displays.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention, which as a matter of language, might be said to fall therebetween.

What is claimed is:

1. An analog display electronic stopwatch comprising elapsed time measuring means including oscillator means for generaging a relatively high frequency time standard signal, divider means for producing relatively low frequency timekeeping signals in a first selected time unit in response to said time standard signal, and counter means for producing a second elapsed time signal in a secondary time unit, said secondary time unit being a fraction of the first selected time unit, said second elapsed time signal being produced at the same time as said high frequency time standard signal is being divided, first hand means including at least one first hand for indicating elapsed time in the selected time unit during time measurement in response to said first selected time unit signals and secondary hand means for indicating time in said secondary time unit after completion of time measurement in said first selected time unit in response to said second elapsed time signal of said counter means and driving means coupled to said counter means for driving said first and secondary hand means.

2. The analog display electronic stopwatch of claim 1, wherein said elapsed time measuring means includes counter means including first counter means for counting said relatively low frequency timekeeping signals to produce the elapsed time signals, driving means coupled to said counter means for driving said hand means, at least one hand of said first hand means being driven by said driving means during elapsed time measurement and second counter means for receiving the second elapsed time signal during elapsed time measurement, said second counter means being coupled to said driving means for driving said secondary hand means upon completion of time measurement and stopping said secondary hand means when the count of said second counter means is coincident to the count of said first counter means.

3. The analog display electronic stopwatch of claim 2, wherein said first counter means is adapted to apply said first selected time unit signal to said driving means for driving said first hand means during time measurement and is further adapted to store the second elapsed time signal therein, said second counter means being adapted to apply a second elapsed time signal to said driving means for driving said secondary hand means upon completion of time measurement, and coincidence detector means for detecting coincidence between the count of said second counter means and the count of said first counter means for cutting off the application of second elapsed signals to said driving means in response to detection of coincidence.

4. The analog display electronic stopwatch of claim 3, further including first manually actuatable switch means coupled to said divider means for selectively starting said divider means counting and stopping said divider means from counting, and resetting means actuated by said switch means and coupled to said second counter means for simultaneously resetting said second counter means for applying a start signal to said second counter means to start same applying said signals through said driving means to drive said secondary hand means until coincidence is detected between the count of said second counter means and the count in said first counter means.

5. The analog display electronic stopwatch of claim 4, wherein said driving means includes first driving means for driving said first hand means in increments of said first seleted time unit in response to the first selected time unit signals counted by said first counter means being applied thereto and second driving means for driving said secondary hand means upon completion of time measurement in increments of the secondary time units in response to said second elapsed time signals counted by said second counter means until coincidence is detected between the count of said second counter means and the count in said first counter means.

6. The analog display electronic stopwatch of claim 5, wherein said driving means includes one step motor for driving said first hand means during elapsed time measurement in movements of said first selected time unit in response to the count of selected time unit signals by first counter means and for driving said secondary hand means after completion of elapsed time measurement in increments of said secondary time unit in response to the count of elapsed time signals by said second counter means.

7. The analog display electronic stopwatch of claim 5, wherein said driving means includes a first step motor for driving said first hand means during elapsed time measurement in increments of said first selected time unit in response to the count of elapsed time signals by said first counter means and a second step motor for driving said secondary hand means upon completion of elapsed time measurement in increments of said secondary time unit in response to the count of said second elapsed time signal by said second counter means.

8. The analog display electronic stopwatch of claim 7, wherein said divider means includes intermediate divider means for producing an intermediate frequency timekeeping signal, manually operated gated divider means for producing a first low frequency timekeeping signal in response to said intermediate frequency timekeeping signal, said gated divider means being adapted to apply said first low frequency timekeeping signal to said first counter means, secondary divider means for producing a second low frequency timekeeping signal in response to said intermediate frequency signal, second gate means for gating the output of said second divider means to said counter means, said coincidence detector means being coupled to the output of said first counter means and said second counter means, said coincidence detector means being coupled to an input of said second gate means for closing said second gate means and cutting off the application of elapsed time signals to said driving means in response to detection of coincidence between the count of said second counter means and the count of said first counter means and actuatable secondary switch means operatively connected to said first switch means for resetting and starting said second counter means upon completion of elapsed time measurement in response to operation of said first switch means.

9. The analog display electronic stopwatch of claim 8, wherein the frequency of the first low frequency timekeeping signal and the frequency of the second low frequency timekeeping signal are the same.

10. The analog display electric stopwatch of claim 9, wherein said frequency is 100 Hz.

11. The analog display electronic stopwatch of claim 9, wherein said first selected time unit is a second and the second fractional time unit is 1/100th of a second.

12. The analog display electronic stopwatch of claim 11, wherein said first hand means includes a seconds hand and a minutes hand and said secondary hand means is a 1/100th of a second hand.

13. The analog display electronic stopwatch of claim 12, wherein said stopwatch has a round display face having an outer elapsed seconds scale therearound for indicating measured elapsed time in seconds by movement of said seconds hand, a first circular minutes scale on a region within said face for indicating measured elapsed time in minutes by movement of said minutes hand, said seconds and minutes hands driven during elapsed time measurement and a 1/100th of a second scale on another region of said face for indicating measured elapsed time in 1/100th of a second by movement of said 1/100th of a seconds hand upon completion of elapsed time measurement.

14. An analog display electronic stopwatch for indicating elapsed time in at least minutes, seconds and 1/100th of a second comprising a seconds hand and a minutes hand driven during elapsed time measurement, a 1/100th of a second hand driving after completion of time measurement and elapsed time measuring means adapted to drive said seconds and minutes hands during elapsed time measurement and said 1/100th of a second hand after completion of elapsed time measurement, said elapsed time measuring means including:

oscillator means for generating a relatively high frequency time standard signal;

intermediate timekeeping divider means for producing intermediate frequency timekeeping signals in response to said standard signal;

first divider means and second divider means each coupled to said intermediate divider means for producing a 100 Hz timekeeping signal in response to said intermediate frequency timekeeping signal;

first gate means including manually operated switch means for selectively gating said intermediate timekeeping signal to said first divider means;

memory counter means coupled to said first divider means for counting said 100 Hz timekeeping signal and producing a 1 Hz elapsed time signal and storing the elapsed 100 Hz time signal therein;

first driving means including first step motor for incrementally advancing said seconds and minutes hands during elapsed time measurement in response to the 1 Hz elapsed time signals from said memory counter means;

secondary counter means for counting said 100 Hz timekeeping signal of said secondary divider means;

second gate means including secondary switch means operatively coupled to said manually operated switch means for gating the 100 Hz signal from said second divider means to said second counter means and to start counting of the 1/100th of a second signals by said second counter means upon operation of said manually operated switch means to stop elapsed time measurement and counting by said memory counter means;

coincidence detector means coupled to the outputs of said memory counter means and said second counter means for detecting coincidence between the count of said second counter means and the count stored in said memory counter means, said coincidence detector means adapted to apply a coincidence signal to said second gate means to cut off counting by said secondary counter means;

secondary driving means including a second step motor for incrementally advancing said 1/100th of a second hand after completion of time measurement in response to the elapsed time signals from said second counter means.

* * * * *